US006367357B1

(12) United States Patent
Thomas

(10) Patent No.: US 6,367,357 B1
(45) Date of Patent: Apr. 9, 2002

(54) POSITIVE ENGAGEMENT SPANNER WRENCH

(76) Inventor: Clint Thomas, 663 Audra Cir., Rhome, TX (US) 76078

( * ) Notice: Subject to any disclaimer, the term of this patent is extended or adjusted under 35 U.S.C. 154(b) by 0 days.

(21) Appl. No.: 09/572,009

(22) Filed: May 16, 2000

(51) Int. Cl.[7] ..... B25B 7/02
(52) U.S. Cl. ..... 81/426; 81/176.1
(58) Field of Search ..... 81/426, 426.5, 81/176.1

(56) References Cited

U.S. PATENT DOCUMENTS

| | | | | | |
|---|---|---|---|---|---|
| 458,337 | A | * | 8/1891 | Dodge et al. | 81/176.1 |
| 478,121 | A | * | 7/1892 | Miller et al. | 81/176.1 |
| 582,238 | A | * | 5/1897 | Schrader | 81/176.1 |
| 1,090,010 | A | * | 3/1914 | Armstrong et al. | 81/426 |
| 3,017,692 | A | * | 1/1962 | Burnell | 81/426 |
| 3,897,701 | A | * | 8/1975 | Daniels et al. | 81/176.1 |
| 4,881,434 | A | * | 11/1989 | Keller | 81/426 |
| 5,285,703 | A | * | 2/1994 | Carson | 81/176.1 |
| 5,469,766 | A | | 11/1995 | Hodges | |
| 5,850,649 | A | * | 12/1998 | Simpson | 81/426 |
| 5,884,540 | A | * | 3/1999 | Mo | 81/426 |
| 6,000,304 | A | | 12/1999 | Hegemier | |
| 6,019,352 | A | | 2/2000 | Mayer | |

* cited by examiner

*Primary Examiner*—Joseph J. Hail, III
*Assistant Examiner*—Joni B. Danganan
(74) *Attorney, Agent, or Firm*—John F. Bryan

(57) ABSTRACT

Apparatus for engaging and turning spanner type threaded members has an upper jaw member extending from a handle and terminating in a 90° arcuate radiused portion. A cylindrical lug extends radially at the end of the radiused portion for engaging the threaded member, and a clamping jaw member is pivotally connected to the handle so as to be diametrically opposed to the lug. The clamping jaw member is forced toward the upper jaw member to provide a clamping force on the threaded member and force the cylindrical lug into positive engagement with the threaded member.

11 Claims, 4 Drawing Sheets

POSITIVE ENGAGEMENT SPANNER WRENCH

TECHNICAL FIELD

The present invention relates to the field of hand tools such as are used for holding and turning collars, and more particularly, to spanner wrenches and vice-grip pliers.

BACKGROUND OF THE INVENTIONS

Power in distribution facilities is commonly supplied by 600 ampere underground electrical lines at 7,200 volts or more. Underground insulated connections and taps are typically made within mechanically and electrically sealed rubber "T" bodies. The insulation is skived from a gauged length of the wire conductor at the end of the electrical cable and a lug is crimped tightly onto the conductor. A tight fitting boot, known as a cable adaptor, is pushed over the cable insulation using silicone sealer both for lubrication and electrical insulation. The assembly is then pushed into the middle leg of a rubber "T" body, using the silicone sealer, first to lubricate, then to seal and insulate the joint. The rubber "T" body is internally keyed to orient the junction eye for a threaded stud inserted axially through the running legs of the "T" body. A connector plug with an internally threaded axial insert is screwed on each end of the threaded stud. Each connector plug has a shouldered body with two symmetrical ends, sized to fit closely within the inside diameter of a "T" body. The shoulders are located to come against the end of a "T" body running leg as the connector plug bottoms against the lug. A hard cylindrical ceramic collar located between the shoulder lands has lug engaging holes set 180° apart so that the connector plug can be tightened with a conventional spanner wrench having a curved head with a lug at one end for fitting into a lug engaging hole. As the opposed connector plugs are tightened on the threaded stud, the lug is clamped tightly between the two plug ends and the shoulders seal against the "T" body. Here again, the joint is sealed and insulated with the silicone sealer.

In the same manner, another "T" body may be joined at the open end of a connector plug, to provide a 200 ampere tap or make a 600 ampere line connection. When an electrical connection is not desired at a "T" body running leg a basic insulation plug is used for closure, instead of a connector plug. Thus, any number of sealed, electrically insulated connections and taps may be provided in an underground electrical line.

When made with the necessary hardness, the ceramic collars are also brittle. As a result, the spanner lug must be fully engaged and the heel of the wrench seated against the surface of the collar so as keep the wrench engaged and allow the application of torsional forces. Otherwise, the ceramic is easily chipped or broken. This is a persistent problem, and frequently, the damage is so severe that the connection must be taken apart in order to replace the broken connector plug.

SUMMARY OF THE INVENTIONS

Therefore, a first object of the present invention is to provide apparatus for positive engagement and tightening of spanner type collars. A second object is that this apparatus engage such collars in a manner that eliminates reliance on frictional forces for torque transmission to such collars. Yet a third object is that this apparatus engage such collars in a manner that eliminates the possibility of imposing a concentrated point load on the collar. Other objects are that the apparatus be easy to apply and use, adaptable to a range of collar sizes and inexpensive to manufacture. in general, and most importantly, for use with the relatively brittle, ceramic type spanner collars. Practice of the present inventions relates to or uses some steps and apparatus well known in the hand tool arts and therefore, not the subject of detailed discussion herein.

The present invention contemplates the aforementioned objectives with a wrench for engaging and turning spanner type threaded members. The wrench has a handle with an extended upper jaw member which terminates in a radiused 90° arcuate portion. A cylindrical lug extends radially at the end of the radiused portion for engaging a spanner type threaded member and a clamping jaw member is pivotally connected to the handle so as to be diametrically opposed to the lug. The clamping jaw member is forced toward the upper jaw member to provide a diametrical clamping force on the threaded member and force the cylindrical lug into positive engagement.

In operation, the cylindrical lug is inserted radially into the engagement hole of a spanner type threaded member and the upper and clamping jaws are adjusted to apply diametrically opposed clamping forces to the threaded member at the generally cylindrical lug, so as to forcibly hold the lug in the engagement hole. A torsional force applied to the wrench forces cylindrical lug tangentially against a side of the engagement hole and the heel of the 90° arcuate portion of the upper jaw bears radially against the periphery of the threaded member to react against the torsional force.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used, and are not to be construed as limiting the inventions to only those examples illustrated and described. The various advantages and features of the present inventions will be apparent from the drawings in which.

DETAILED DESCRIPTION OF THE DRAWINGS

Figure 1:
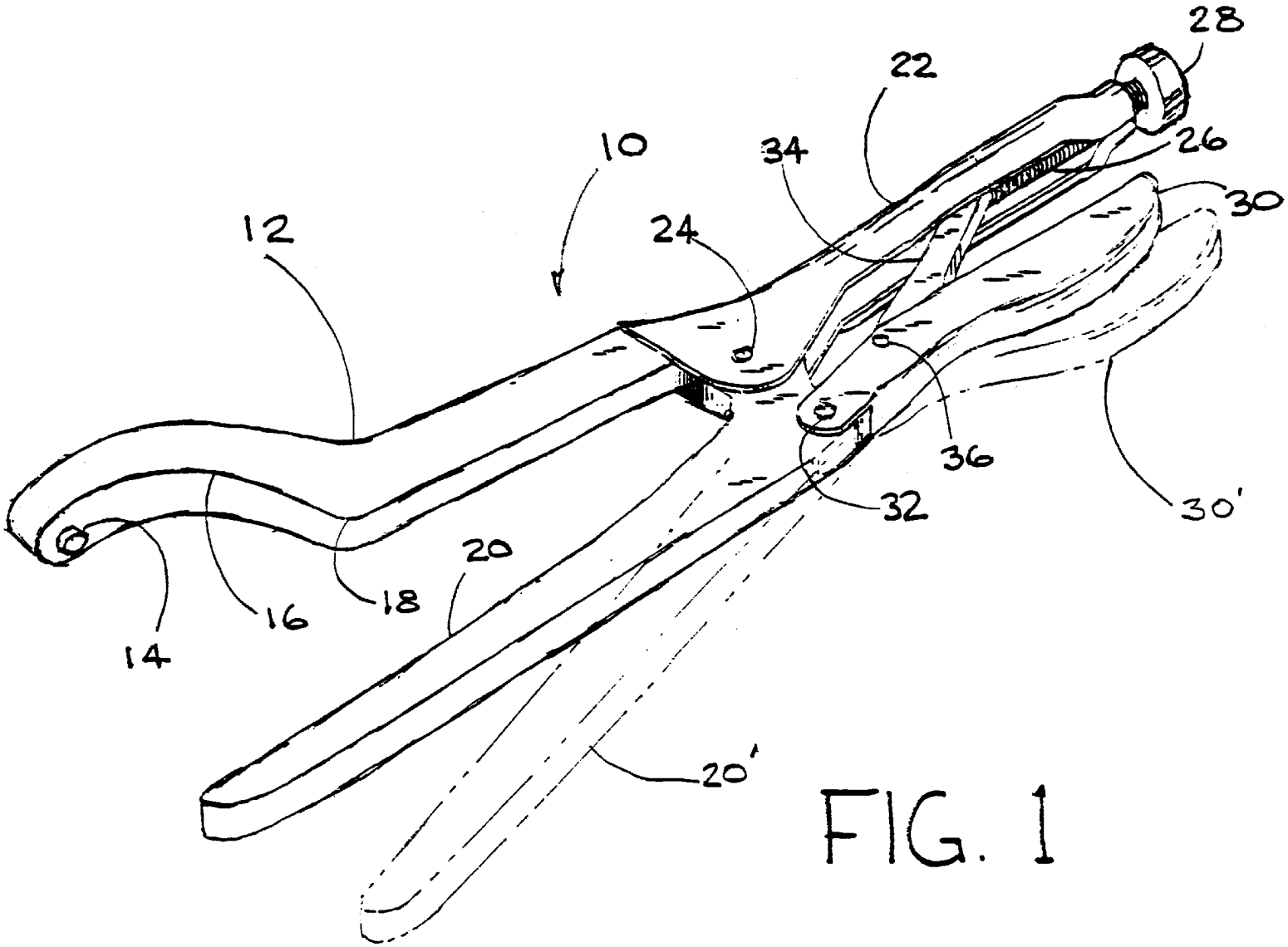
FIG. 1 shows a perspective view of a preferred embodiment of the present inventions.

The embodiments shown above and described herein are exemplary. Many details are well known in the art, and as such are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims.

Figure 2:
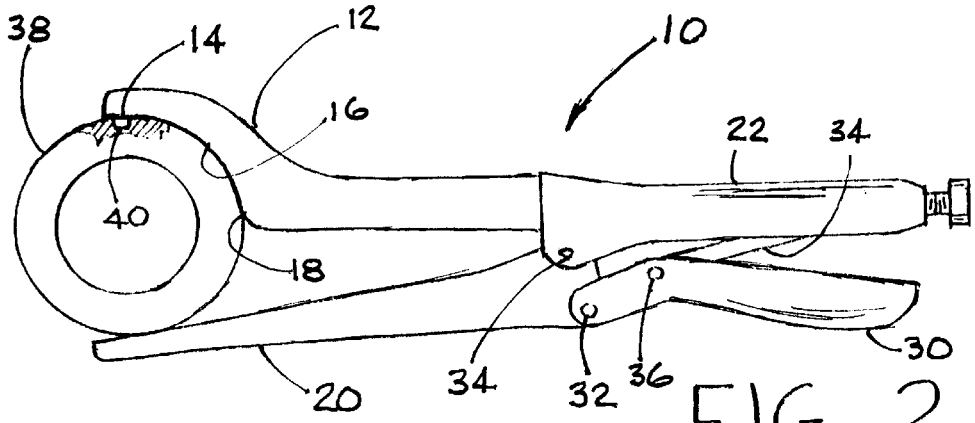
FIG. 2 shows a side view of the preferred embodiment of FIG. 1 as applied for holding and turning a collar.

FIGS. 1 and 2 show wrench 10, a preferred embodiment incorporating the present inventions. FIG. 1 is a perspective view showing a preferred embodiment of wrench 10, illustrative of embodiments expressing the present inventions. Wrench 10 features fixed jaw 12, including cylindrical lug 14 and radiused surface 16 extending to heel 18. Handle 22 is rigidly adjoined to fixed jaw 12 and includes pivotal connection 24 for the attachment of clamping jaw 20. Handle 22 also includes adjusting screw 26 which is set by turning adjustment knob 28. Gripping lever 30 is pivotally connected to clamping jaw 20 at connecting pin 32 and compression link 34 in turn, is pivotally connected to gripping lever 30 at connecting pin 36. In use, gripping lever 30 is squeezed toward handle 22 to place connecting pin 36 of compression link 34 in an "over-center", locking position with respect to connecting pin 32 as is shown in FIG. 2. The "open" configuration of wrench 10 is indicated by the phantom line positions shown for clamping jaw 20' and gripping lever 30'. The setting of adjusting screw 26 adjusts the closed position of clamping jaw 20 as well as the clamping pressure it exerts.

FIG. 2 shows a side view of wrench 10 of FIG. 1 as it appears in use for holding and turning a collar 38. Lug 14 engages a mating hole 40 expressly provided in the surface of collar 38. Fixed jaw 12 is held against collar 38 by clamping jaw 20, adjusted in the above described manner and radiused surface 16 is made to bear against the surface of collar 38 so as to hold lug 14 in alignment with hole 40. This positive engagement avoids the possibility of highly concentrated loads that would be caused by any cocking of lug 14. Heel 18 bears against the external surface of collar 38, where it serves to react against turning forces and hold coupling 38 as shown below.

Figure 3:
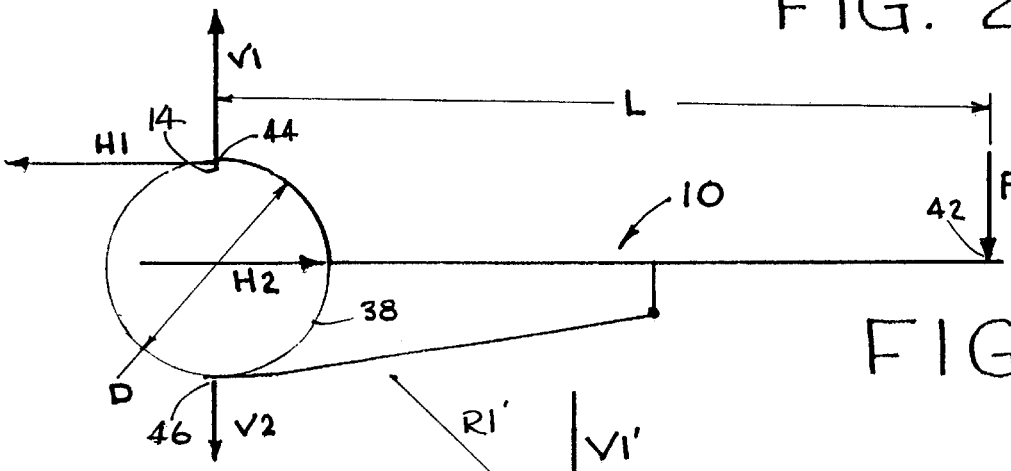
FIG. 3 shows a free body force analysis of a wrench incorporating the present inventions, as loaded in normal use.

Prior art FIG. 3 is a schematic "free body" diagram showing the forces that act on a conventional spanner wrench 50 as it is used to hold and turn collar 38 in the conventional manner. Force "P" is applied at point 52, located a distance "L" from lug 54, inserted in hole 40 on diameter "D" of collar 38. The moment resulting from force "P" is reacted by the coupling of forces R1H and R2H. If, as before, it is assumed that L is equal to 11 inches, D is equal to 2 inches and P is equal to 20 pounds, it can be readily shown that R1V is equal to 89.5 lbs., R1H is equal to 109.5 lbs., R2V is equal to 109.5 lbs. and R2H is equal to 109.5 lbs. Combining these vector forces shows that R1 is equal to 141.4 lbs., acting at the angle 56 of 39.3° and that R2 is equal to 154.9 lbs., acting at the angle 56 of 45.0°. In actual practice, R2H and R2V represent the sum of an indeterminate force distribution along the surface of radius 58 and heel 60 of wrench 50.

Figure 4:
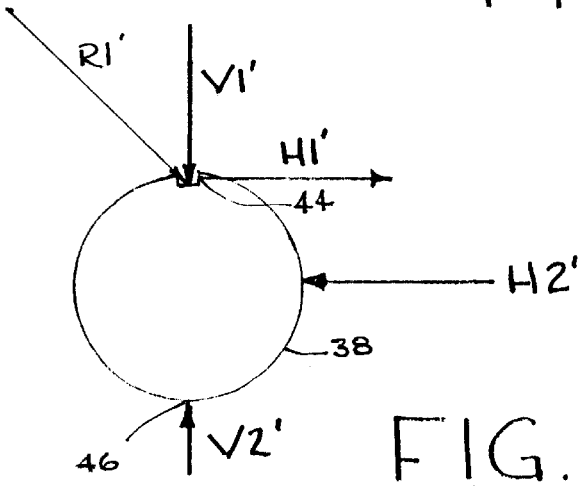
FIG. 4 shows the forces imposed on a coupling, when being tightened by a wrench incorporating the present inventions.

FIG. 4 shows the forces imposed on collar 38 in reaction to R1 and R2 as derived from prior art FIG. 3. R1', at the side wall of hole 40, is equal and opposite to R1 and is the resultant of R1V' and R1H'. R2', 90° displaced from hole 40, is equal and opposite to R2 and is the resultant of forces R2V' and R2H'. It should be noted that force R1V is a downwardly directed component in FIG. 3, so that force R1V' of FIG. 4 is upwardly directed. Lug 54 is seen to be held in engagement by frictional and mechanical forces acting against the side wall of hole 40. Thus, even when wrench 50 is used in the ideal manner, the side wall of hole 40 is subjected to an upwardly directed shear stress, in combination with compressive stress. From this it can be seen that the unobvious result of the present invention, in addition to the elimination of problems having to do with alignment and full engagement of the spanner lug, is the elimination of R1V' as a shear inducing force on the side wall of hole 40. When it is considered that connector plug collars are ceramic and shock loading may be involved in tightening plug connections, and that conventional spanner wrenches lack means for holding the engaging lug tightly in contact, it is readily seen that collar breakage can occur frequently with prior art tools and methods.

Figure 5:
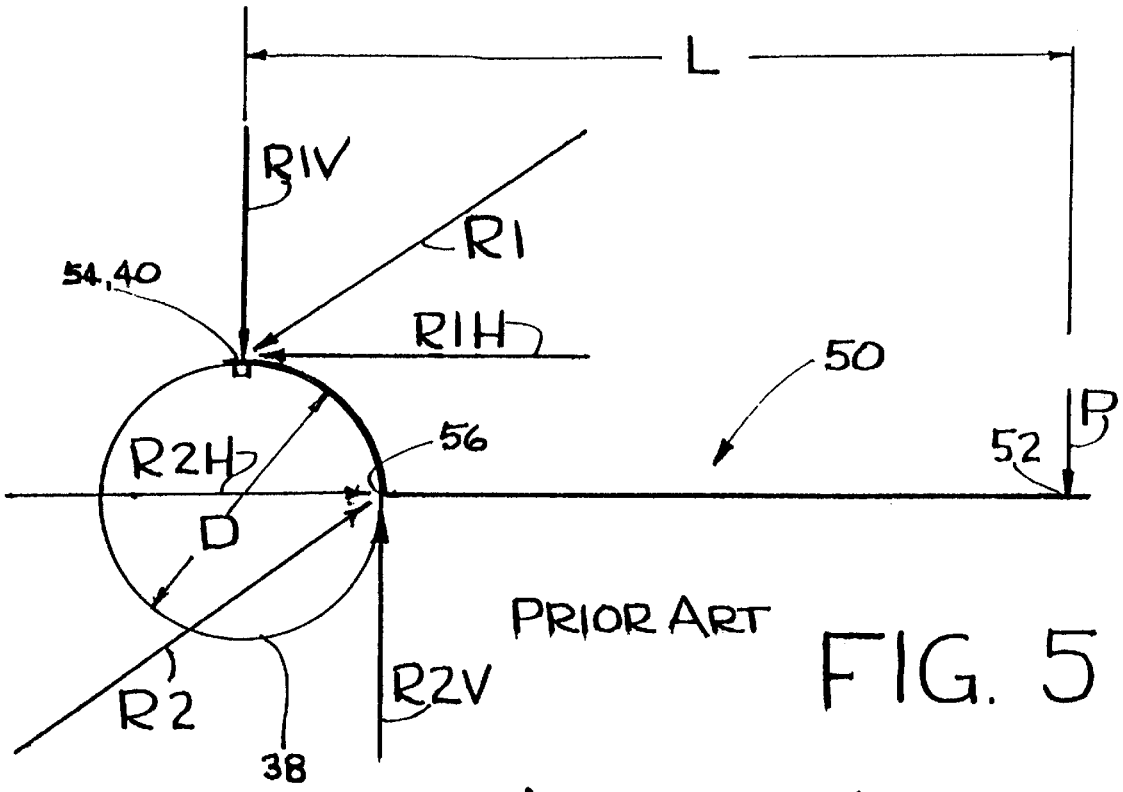
PRIOR ART FIG. 5
FIG. 5 shows a free body force analysis of a conventional spanner wrench, as loaded in normal use.

FIG. 5, a schematic "free body" diagram, shows the forces acting on wrench 10 as it holds collar 38 in the manner described above. Force P is applied at point 42, located a distance L from lug engagement point 44 on diameter D. A clamping force is applied to collar 38 by fixed jaw 12 at lug 14 and clamping jaw 20 at diametrically opposed point 46. The forces on wrench 10 that react to these clamping forces are shown as forces V1 and V2. Force V2 minus force V1 is equal to Force P. The torsional moment of force P is reacted by the coupling of forces H1 and H2, acting at 90° to force P.

Figure 6:
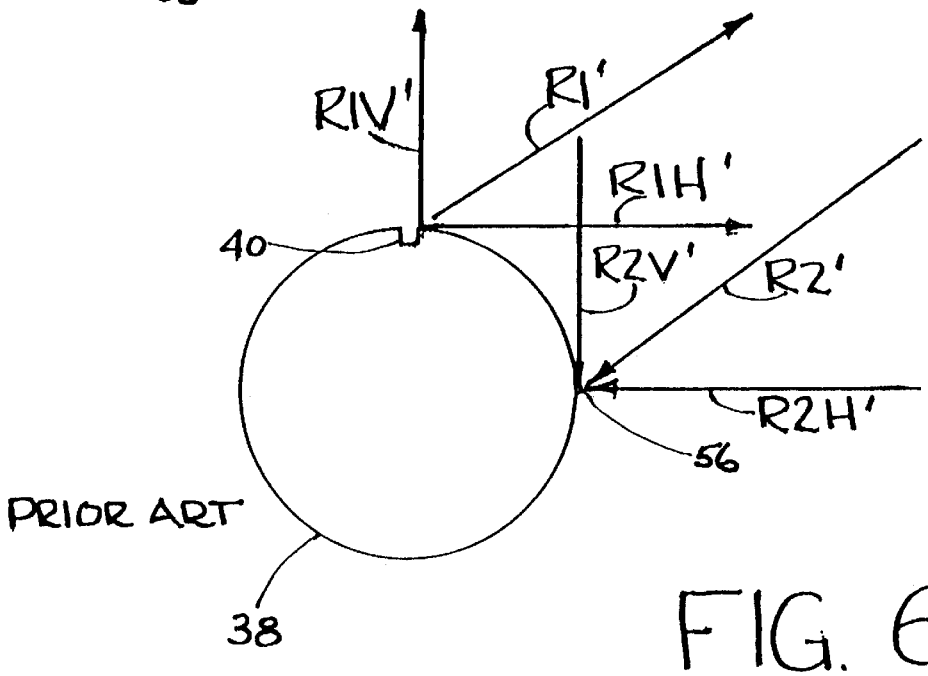
PRIOR ART FIG. 6
FIG. 6 shows the forces imposed on a coupling, when being tightened by a conventional spanner wrench.

FIG. 6 shows coupling 38 with forces, V1', V2', H1' and H2' reacting to the equivalent forces derived from FIG. 5. If it is assumed that L is equal to 10 inches, D is equal to 2 inches and P is equal to 20 pounds, it can be readily shown that H1' and H2' equal 200 pounds; that V1' equals 40 pounds and that V2' equals 20 pounds. It should be noted that forces V1', V2' and H2' are applied radially on collar 38 and that the torsional force H1' is applied in the ideal manner, perpendicular to lug 14. The resultant force R1' is seen to be directed downwardly, against the body of collar 38. The significance of this geometry will become apparent when compared to that of a conventional spanner wrench as shown and described for FIGS. 3 and 4.

Figure 7:
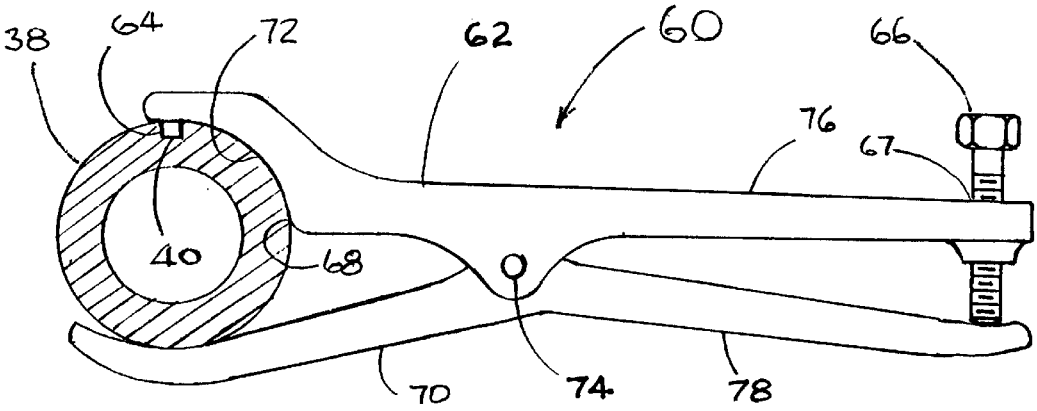
FIG. 7 shows a first alternative form of the present invention.

FIG. 7 shows wrench 60, an alternative embodiment of the present invention. Here, wrench 60 is seen to engage collar 38 in the same manner as did wrench 10 of FIGS. 1 & 2. Clamping jaw 70 is connected to fixed jaw 62 at pivot point 74 and handle member 76 extends from fixed jaw 62. Hexagonal cap screw 66 in threaded hole 67 bears against extension 78 of clamping jaw 70. Adjustment of hexagonal cap screw 66 urges clamping jaw 70 against collar 38. Lug 64, at the tip of fixed jaw 62, is inserted into mating hole 40 of collar 38 prior to tightening screw 66. Clamping jaw 70 contacts collar 38 at a point diametrically opposed to hole 40 and exerts a force which holds lug 64 in positive engagement. Concurrently, radiused surface 72 and heel 68 bear against the external surface of collar 38 to react against turning forces applied by wrench 60. The free body force diagram for wrench 60, and the forces applied to collar 38 thereby, are essentially as shown in FIGS. 5 & 6 respectively.

Figure 8:
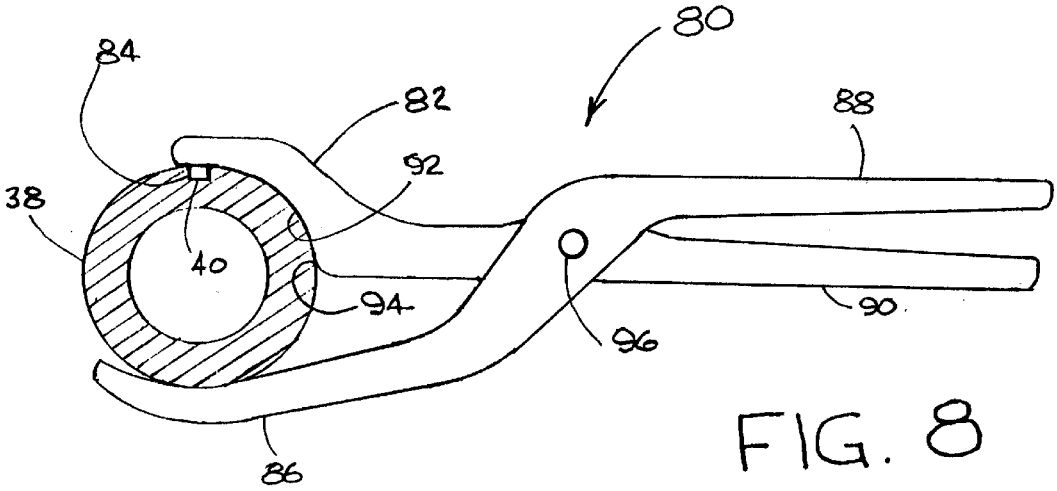
FIG. 8 shows a second alternative form of the present invention.

FIG. 8 shows wrench 80, a second alternative embodiment of the present invention. Here, wrench 80 is shown engaging collar 38 in the same manner as did wrench 10 of FIGS. 1 & 2. Lug 84 engages mating hole 40 of collar 38 and fixed jaw 82 is held against collar 38 by clamping jaw 86. Clamping jaw 86 is connected to fixed jaw 82 at pivot point 96 and the user's grip squeezes clamping jaw handle 88 toward fixed jaw handle 90. In this manner, lug 84 is held in full engagement with hole 40 while radiused surface 92 bears against the surface of collar 38. Heel 94 bears against the external surface of collar 38 to react against turning forces applied by wrench 80. The free body force diagram for wrench 80, and the forces applied to collar 38 thereby, are essentially as shown in FIGS. 5 & 6 respectively.

The embodiments of the present invention illustrated in FIGS. 1, 2, 7 and 8 share the common characteristic in the provision of an opposed, clamping force (V2' in FIG. 6) to offset the upwardly directed vertical component R1V' imposed on the engagement hole side wall of the prior art practice as shown in FIG. 4.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad meaning of the terms of the attached claims.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus for engaging and turning a spanner type threaded part, comprising:

a handle having a longitudinal axis;

a first member extending from the handle substantially along the longitudinal axis and terminating in a radiused portion subtending an arc of approximately ninety degrees, the arc radius being substantially the same as a spanner type threaded part;

a generally cylindrical lug having a longitudinal axis extending radially from the radiused portion and proximate the extended end thereof;

a second member pivotally connected to the handle and extending to be in diametrical opposition to the lug; and means for urging the second member toward the first member.

2. Apparatus for engaging and turning a spanner type threaded part according to claim 1, wherein means for urging the second member toward the first member comprises:

a linkage operationally connected between the handle and the second member, the linkage including a compression link positionable in an over-center and locking position.

3. Apparatus for engaging and turning a spanner type threaded part according to claim 1, wherein means for urging the second member toward the first member comprises:

a second member extension juxtaposed to the handle so that manually applied gripping forces urge the second member extension toward the handle and the second member toward the first member.

4. Apparatus for engaging and turning a spanner type threaded part according to claim 1, wherein means for urging the second member toward the first member comprises:

a second member extension juxtaposed to the handle; and a threaded member engaging matching threads in the handle and bearing against the second member extension so that turning the threaded member will urge the second member extension away from the handle and the second member toward the first member.

5. Apparatus for engaging and turning a spanner type threaded part according to claim 1, wherein means for urging the second member toward the first member comprises:

a second member extension juxtaposed to the handle; and a threaded member engaging matching threads in the second member extension and bearing against the handle so that turning the threaded member will urge the second member extension away from the handle and the second member toward the first member.

6. Apparatus engaging a spanner wrench compatible threaded part, comprising:

a spanner wrench compatible threaded part having a peripheral engagement hole with a radially oriented side wall;

a generally cylindrical lug projecting radially into the engagement hole;

an arcuate lug supporting member extending partially around the periphery of the spanner wrench compatible threaded member and bearing thereagainst at an angle substantially perpendicular to opposed clamping forces to the spanner wrench compatible threaded part at, and opposite to, the generally cylindrical lug so as to forcibly hold the cylindrical lug in the engagement hole; and means for forcing the cylindrical lug tangentially against a side wall of the engagement hole and turning the spanner wrench compatible threaded part.

7. Apparatus engaging a spanner wrench compatible threaded part according to claim 6, wherein means for applying opposed clamping forces comprises:

a handle member extending from the cylindrical lug supporting member;

an opposed member pivotally connected to the handle member so as to contact the periphery of the spanner wrench compatible threaded member at a location generally opposed to the peripheral engagement hole; and a linkage operationally connected between the handle and the second member, the linkage including a compression link positionable in an over-center and locking position.

8. Apparatus engaging a spanner wrench compatible threaded part according to claim 6, wherein means for applying opposed clamping forces comprises:

a handle member extending from the cylindrical lug supporting member;

an opposed member pivotally connected to the handle member so as to contact the periphery of the spanner wrench compatible threaded member at a location generally opposite to the peripheral engagement hole; and an opposed member extension juxtaposed to the handle so that manually applied gripping forces urge the second member extension toward the handle and the opposed member toward the cylindrical lug.

9. Apparatus engaging a spanner wrench compatible threaded part according to claim 6, wherein means for applying opposed clamping forces comprises:

a handle member extending from the cylindrical lug supporting member;

an opposed member pivotally connected to the handle member so as to contact the periphery of the spanner wrench compatible threaded member at a location generally opposed to the peripheral engagement hole; and a threaded member engaging matching threads in the handle member and bearing against the opposed member, so that turning the threaded member will urge the opposed member to pivot on the handle.

10. Apparatus engaging a spanner wrench compatible threaded part according to claim 6, wherein means for applying opposed clamping forces comprises:

a handle member extending from the cylindrical lug supporting member;

an opposed member pivotally connected to the handle member so as to contact the periphery of the spanner wrench compatible threaded member at a location generally opposed to the peripheral engagement hole; and a threaded member engaging matching threads in the opposed member and bearing against the handle member, so that turning the threaded member will urge the opposed member to pivot on the handle.

11. A method for engaging and turning a spanner type threaded part comprising the steps of:

providing a spanner type threaded part with a peripheral engagement hole having radially oriented sides;

inserting a generally cylindrical lug radially into the engagement hole;

applying diametrically opposed clamping forces to the threaded member at and opposite to the generally cylindrical lug, so as to forcibly hold the lug in the engagement hole;

forcing the cylindrical lug tangentially of the spanner type threaded part to bear against a side of the engagement hole; and reacting the tangential force radially against the periphery of the spanner type threaded part, at a location displaced approximately ninety degrees from the peripheral engagement hole.

* * * * *